US005105989A

United States Patent [19]

Gutkowski

[11] Patent Number: 5,105,989

[45] Date of Patent: Apr. 21, 1992

[54] MODULAR NON-AEROSOL DISPENSING OVERCAP

[75] Inventor: Ronald R. Gutkowski, Racine, Wis.

[73] Assignee: S. C. Johnson & Son, Inc., Racine, Wis.

[21] Appl. No.: 578,703

[22] Filed: Sep. 4, 1990

[51] Int. Cl.[5] ..... B67D 5/06

[52] U.S. Cl. ..... 222/182; 222/212; 222/562

[58] Field of Search ..... 222/182, 212, 498, 546, 222/556, 562, 563, 402.13, 545, 78, 525

[56] References Cited

U.S. PATENT DOCUMENTS

| | | | |
|---|---|---|---|
| D. 195,701 | 7/1963 | Chermayeff | D58/17 |
| D. 295,834 | 5/1988 | Crapser | D9/300 |
| 2,761,833 | 9/1956 | Ward | 222/212 |
| 2,887,273 | 5/1959 | Anderson et al. | 239/337 |
| 2,998,902 | 9/1961 | Thomas et al. | 222/499 |
| 3,059,816 | 10/1962 | Goldstein | 222/543 |
| 3,094,250 | 6/1963 | Molyneaux et al. | 222/212 |
| 3,109,565 | 11/1963 | Kutik | 222/394 |
| 3,138,331 | 6/1964 | Kutik | 239/337 |
| 3,212,680 | 10/1965 | Crowell et al. | 222/182 |
| 3,227,332 | 1/1966 | Gowdy et al. | 222/525 |
| 3,323,695 | 6/1967 | Monahon | 222/202.13 |
| 3,516,581 | 6/1970 | Micallef | 222/529 |
| 3,539,078 | 11/1970 | Venus, Jr. | 222/153 |
| 3,542,256 | 11/1970 | Waterman | 222/484 |
| 3,578,220 | 5/1971 | Green et al. | 222/402.13 |
| 3,881,638 | 5/1975 | Grothoff | 222/153 |
| 3,887,115 | 6/1975 | Petterson | 222/402.13 |
| 4,013,231 | 3/1977 | VanVeldhoven | 222/402.11 |
| 4,022,352 | 5/1977 | Pehr | 222/546 |
| 4,047,646 | 9/1977 | Lo et al. | 222/402.13 |
| 4,254,899 | 3/1981 | van Lit | 222/402.13 |
| 4,314,656 | 2/1982 | Kessler | 222/525 |
| 4,378,081 | 3/1983 | van Lit | 222/402.13 |
| 4,457,458 | 7/1984 | Heinol | 222/498 |
| 4,600,130 | 7/1986 | Libit | 222/209 |
| 4,620,646 | 11/1986 | Crapser | 222/153 |
| 4,629,081 | 12/1986 | McLaren | 215/206 |
| 4,645,086 | 2/1987 | Rosenthal | 215/235 |
| 4,807,781 | 2/1989 | Bobinger et al. | 222/546 |
| 4,813,577 | 3/1989 | Carow | 222/525 |
| 4,838,441 | 6/1989 | Chernack | 215/216 |

FOREIGN PATENT DOCUMENTS

| | | | |
|---|---|---|---|
| 1003498 | 12/1988 | Spain . | |
| 560144 | 3/1975 | Switzerland | 222/402.13 |

OTHER PUBLICATIONS

5 Color Photographs of Dispensing Container of "Soft Shave TM Moisturizing Shave Lotion with Aloe", manufactured for White Laboratories, Inc., Orlando, Fla. 32858.

5 Color Photographs of Dispensing Container for "Aloe 50 TM Nourishing Lotion for Dry Skin", by Yardley of London, Inc., Chicago, Ill. 60611.

"Pledge(®)", Furniture Polish Aerosol Can 2-Piece Overcap, 14 oz. Container, S. C. Johnson & Son, Inc., Racine, Wis. (1988), 4 Photographs.

"Deep Woods Off!(®)", Aerosol Pump Spray Container 2-Piece Overcap, S. C. Johnson & Son, Inc., Racine, Wis. (1982), 4 Photographs.

*Primary Examiner*—Michael S. Huppert

*Assistant Examiner*—Kenneth Bomberg

[57] ABSTRACT

A non-aerosol dispensing overcap closure (12) for a container (11) filled with a fluid medium is composed of a (A) dispenser/container seal unit (13) which both seals the open end (15) of the container (11) and contains a non-aerosol means (31-34) for dispensing the fluid medium within the container (11) and further contains at least one flange (38) extending from an exterior wall of the seal unit (13) for receiving (B) a shroud member (14) which overlies the seal unit and through which the dispensing means (31-34) extends to permit the fluid medium to pass through the shroud member (14). The shroud member (14) is adapted to form an integral portion of the container (11) and thus aesthetically blends in with the design of the container (11) to form an attractive non-aerosol container package (10). The shroud member (14) contains a means for fixing an interior surface (39) of the shroud member to the flange (38) of the seal unit (13) which can be in the form of plastic pins (36) extending from the interior surface (39) of the shroud member (14) through corresponding openings (37) in the flange (38) or flanges (38) of the seal unit (13) to permit permanent attachment of the shroud member (14) to the seal unit (13). The overcap (12) has the advantage that the same dispenser/container seal unit (13) can be used with a variety of shroud members (14) and thus on a variety of containers (11).

4 Claims, 2 Drawing Sheets

MODULAR NON-AEROSOL DISPENSING OVERCAP

TECHNICAL FIELD

This invention relates to a modular non-aerosol dispensing overcap closure for a container filled with a liquid medium composed of a dispenser/container seal unit for the container which has at least one flange so that it can be fixed to a shroud member which forms the exterior of the overcap.

BACKGROUND ART

Since consumers often purchase a product based upon aesthetic as well as functional considerations, a consumer product package designer must strive to provide such containers with a dispensing system which is attractive, reasonable in cost and easy to use. To achieve these ends, custom-made molds designed for each dispensing system and the container on which it will be placed must be designed and built. This often requires a large inventory of different parts as well as design considerations in making parts molds and assembling the parts which introduce cost disadvantages when a large number of consumer product packages are to be made for sale.

A more aesthetically pleasing consumer product package can be made by integrating the dispenser into the overall package design through the use of an overcap which surrounds the dispenser. Thus, a number of consumer product package designs use a one piece overcap which includes a dispensing means as well as a container seal so that the overcap/ dispenser seal unit is simply snapped onto the container and is integrated within the overall design of the consumer product package itself. Examples of such overcap/dispensers can be seen in U.S. Pat. Nos. 4,600,130 to Libit and 4,807,781 to Bobinger and Gutkowski. Use of such overcaps/dispensers have some disadvantages in that a separate mold is typically needed for each container size and design. Particularly in the case of a flip-top dispenser, a separate machine which receives the molded overcap/dispenser and closes the flip-top prior to mounting on the container is necessary for the high speed packaging operations which are required for high volume consumer products. Since such machines are set up to be specific for the size and shape of the overcap/dispenser, the manufacturer must either invest in several machines if he wishes to make several different sizes of caps or spend unproductive time resetting one machine to receive a different size overcap/dispenser.

Pressurized aerosol and pump spray aerosol containers often employ the use of a plastic overcap which is shaped in such a manner as to blend in with the overall package design. In some cases, an aerosol actuator button is mounted on a valve or pump outlet and is free of any contact with a separate overcap such as is shown in U.S. Pat. Nos. 3,881,638 to Grothoff and U.S. Pat. No. 4,378,081 to van Lit and in Spanish Utility Model No. 1,003,498 to S. C. Johnson & Son, Inc. More commonly, the plastic overcap contains guides or channels or some other means for keeping the actuator button in line with an exit orifice or open area in the overcap itself so that the aerosol spray is directed in the proper direction, such as are shown in U.S. Pat. Nos. 3,109,565 to Kutik (a lever arm on the overcap presses down upon an actuator button which has a projecting lug engaging with a groove in the overcap); U.S. Pat. No. 3,138,331 to Kutik (an upward extending shank retains the actuator button in alignment); U.S. Pat. No. 3,212,680 to Crowell et al. (the aerosol actuator button is guided by a channel formed in the center of the overcap); U.S. Pat. No. 3,539,078 to Venus, Jr. (a one piece actuator/overcap assembly where the aerosol actuator button is molded as a part of the plastic overcap and is released by pulling a tear strip temporarily joining the cap and actuator button); U.S. Pat. No. 3,578,220 to Green et al. (the aerosol valve actuator button is molded to the overcap and downward pressure on the button causes it to disengage and fit onto the valve stem of the aerosol container whereby the button seats on the valve stem and is no longer in contact with the overcap); U.S. Pat. No. 4,047,646 to Lo et al. (an actuator button is contained within a plastic overcap and combined with a surface having effective and ineffective areas for use as a child-safe aerosol actuator); U.S. Pat. No. 4,254,899 to van Lit (an aerosol actuator button is guided by means of alignment pin located on the overcap) and U.S. Pat. No. 4,620,646 to Crapser (a plastic overcap contains guides which fit in channels in the side of the pump actuator button to maintain it in alignment with the opening in the overcap) In all of the immediately preceding patents, the overcap snaps directly onto the container and the actuator button is mounted on the valve stem or pump stem of the container.

U.S. Pat. No. 2,887,273 to Anderson et al. shows a spray dispensing assembly for an aerosol container which is composed of a plastic overcap which seats within the edge of the aerosol container. The actuator button is carried within a second circular member which snaps over the valve cup of the container and is smaller in diameter than the plastic overcap. The outside plastic overcap can be rotated around the inner circular member to either prevent the container from being actuated or to provide either a fine or a coarse spray. A portion of the outer overcap engages with the periphery of the circular inner member so that the outer cap can be rotated to select the spray desired.

A plastic overcap dispenser found on a number of consumer products sold by S. C. Johnson & Son, Inc. such as PLEDGE® furniture polish has a plastic overcap which snaps over the valve cup on the aerosol container. An actuator button fitting over the valve stem of the container is snapped within guides found in the center of that plastic overcap so that the valve actuator button is contained within the plastic overcap. The button is restricted in its movement to an up and down motion so that the discharge opening of the actuator button is retained within a small opening in the side of the plastic overcap. The spray is then directed through an opening in the plastic overcap when the actuator button is pressed. The actuator button is only attached to the valve stem of the aerosol container.

SUMMARY DISCLOSURE OF THE INVENTION

To overcome the disadvantages of the prior art overcap/dispensers, it would be desirable to have an overcap/dispenser for non-aerosol containers manufactured from components which are easier to mold, require less labor intensive operations to assemble, reduce the number of parts which must be kept in inventory for various container sizes and provide flexibility in permitting the manufacturer to use a single dispenser with different overcap configurations to permit a rapid change in container design or to permit the use of a single dispensing closure with a variety of containers of different shapes.

Therefore, it is an object of this invention to overcome the disadvantages of the prior art with respect to overcap/dispenser units for non-aerosol containers filled with a fluid medium. A further object is to provide the desirable features mentioned above by providing a non-aerosol dispensing overcap closure for a container having an open end and filled with a fluid medium which comprises (A) dispenser/container seal unit which seals the open end of the container and also contains a non-aerosol means for dispensing a fluid medium within the container which further contains at least one flange extending from an exterior wall of the seal unit for receiving (B) a shroud member which overlies the seal unit and through which the dispensing means extends to permit the fluid medium to pass through the shroud member. The shroud member is adapted to form an integral portion of the container and thus aesthetically blends in with the design of the container. The shroud member contains the means for fixing an interior surface of the shroud member to the flange of the seal unit which can be in the form of plastic pins extending from the interior surface of the shroud member through corresponding openings in the flange or flanges of the seal unit to permit permanent attachment of the shroud to the seal unit. Alternatively, the flanges could be screwed onto the shroud, heat-sealed, or simply adhered with an adhesive to form the overcap of the present invention.

The present invention permits the manufacturer to stock a single dispenser/container seal unit which can be used on a variety of containers having the same container opening size. The dispenser/container seal unit can be assembled by a single machine when it is ejected from the mold such as to close a flip-top closure or to insert a hinged closure which plugs the opening in the dispenser portion of the seal unit. A variety of shapes and sizes of shroud members can be provided for attachment to the dispenser/seal unit and thus can be used on a variety of containers.

BRIEF DESCRIPTION OF THE DRAWINGS

The above and other objects, features and advantages of the present invention will become apparent to those skilled in the art upon an examination of the following description and Drawings which are merely illustrative of the present invention. A preferred embodiment of the present invention is illustrated in the accompanying Drawings to enable those skilled in the art to better practice the present invention. Like parts are given like numbers in the Drawings.

BEST MODE FOR CARRYING OUT THE INVENTION

Figure 1:
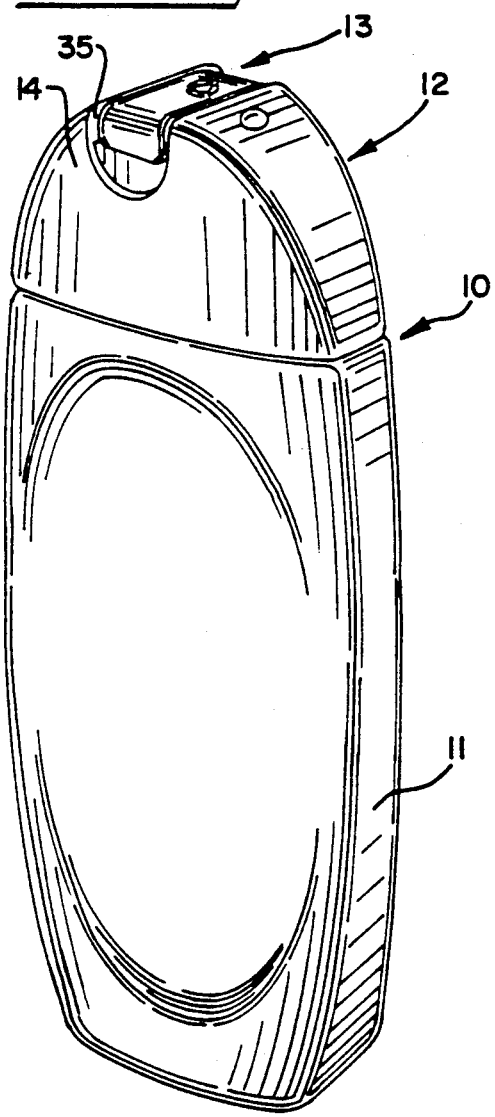
FIG. 1 is a perspective view of an assembled container package containing a non-aerosol dispensing overcap closure of the present invention.

FIG. 1 shows an assembled non-aerosol container package 10 comprising an open-ended container 11 and a non-aerosol dispensing overcap closure 12 composed of a dispenser/ container seal unit 13 which is fixed to shroud member 14. Container 11 may be made of any suitable material such as a plastic such as high density polyethylene, polypropylene or polyethylene terephthalate or glass. Dispenser/container seal unit 13 and shroud member 14 are preferably constructed from a suitable plastic such as high density polyethylene or polypropylene. For reasons of economy and ease of molding, plastics such as high density polyethylene are preferred. The actual material from which these components are made forms no part of the present invention. These components are molded or otherwise manufactured in accordance with techniques which are well known to those of ordinary skill in the art.

Figure 2:
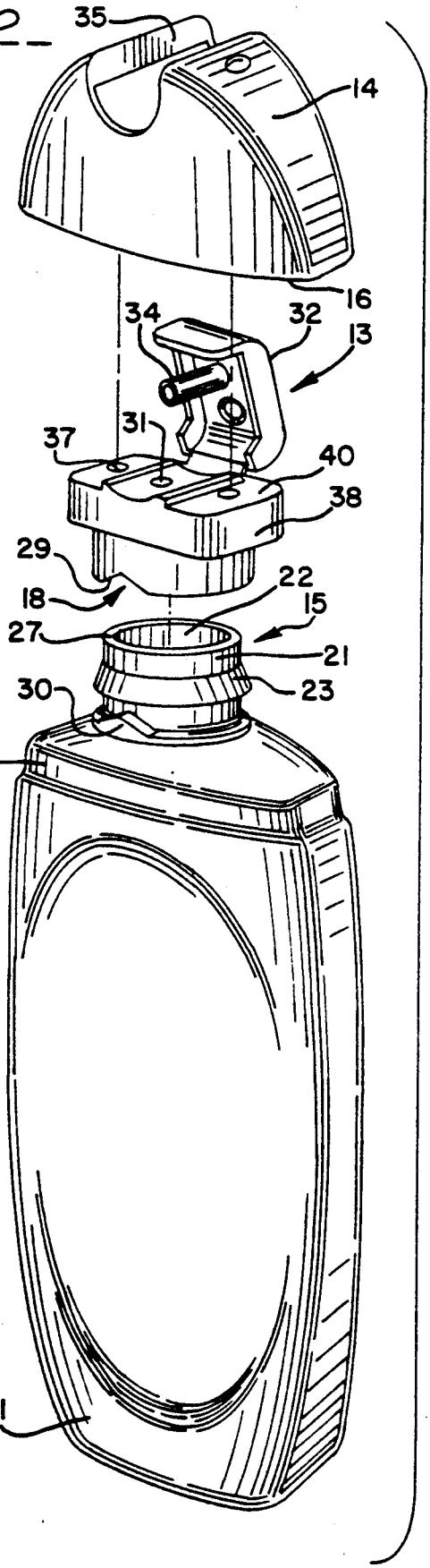
FIG. 2 is an exploded view of FIG. 1 showing its components with the flip-top on the dispenser/seal unit in an open position.

Referring to FIG. 2, this exploded view shows the multicomponent nature of overcap closure 12 and how dispenser/ container seal unit 13 can be fitted over open end 15 of container 11. FIG. 2 illustrates how lower edge 16 of shroud member 14 is shaped in such a manner as to form an integral portion of the design of container 11 by fitting over shoulder 17 of container 11 such that lower edge 16 blends in with the contours of container 11 to provide an aesthetically pleasing appearance to package 10 as can be seen in FIG. 1.

Figure 6:
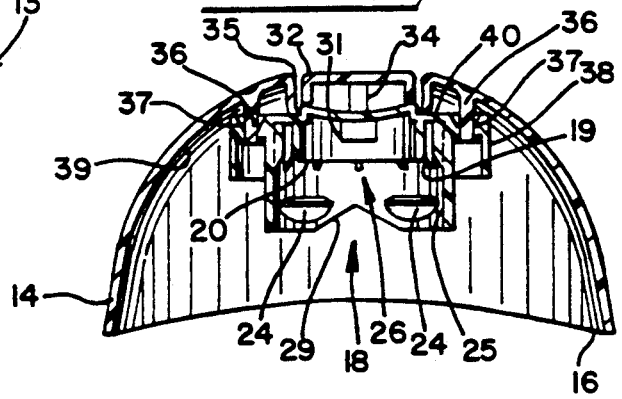
FIG. 6 is a cross-sectional view, taken along lines 6—6 of FIG. 5, showing the attachment of the dispenser/container seal unit to the shroud member.
Figure 5:
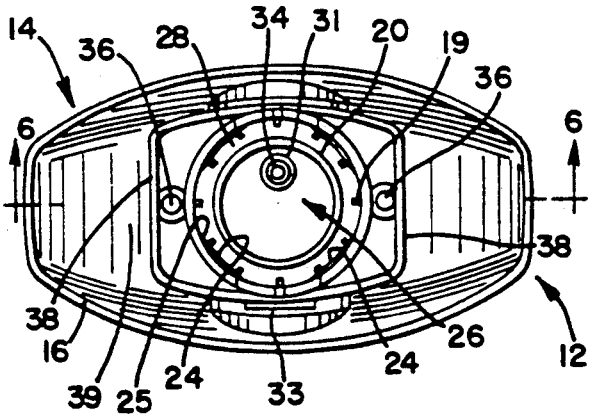
FIG. 5 is a bottom plan view of the shroud member shown with the dispenser/container seal unit affixed therein.

FIGS. 2, 5 and 6 show the manner in which dispenser/ container seal unit 13 fits over open end 15 for sealing engagement with open end 18 of dispenser/container seal unit 13. Open end 18 contains a conventional stake-on sealing mechanism composed of a plurality of guides 19 and ring 20 which engage the outer peripheral wall 21 and the inner peripheral wall 22, respectively, of open end 15 of container 11. Open end 15 further contains annular projection 23 which rides over projections 24 on interior side wall 25 located in interior region 26 of dispenser/container seal unit 13. Dispenser/container seal unit 13 is pressed down onto open end 15 until annular projection 23 slides over projections 24 and upper edge 27 of open end 15 contacts roof 28 of interior 26. Interior 26 is then in communication with the interior of container 11 and seal unit 13 is retained on container 11. Open end 18 has triangular indentations 29 which fit over triangular projections 30 molded into the lower edge of open end 15 of container 11. Application of a twisting force to dispenser/container seal unit 13 after it is sealed onto container 11 will force seal unit 13 away from open end 15 and permit removal of seal unit 13 from container 11. Opening 31 communicates with interior 26 to permit dispensing of the fluid medium contained within container 11 when fliptop 32 attached to dispenser/container seal unit 13 by means of hinge 33 is pushed up to remove closely fitting plug 34 from opening 31.

Figure 4:
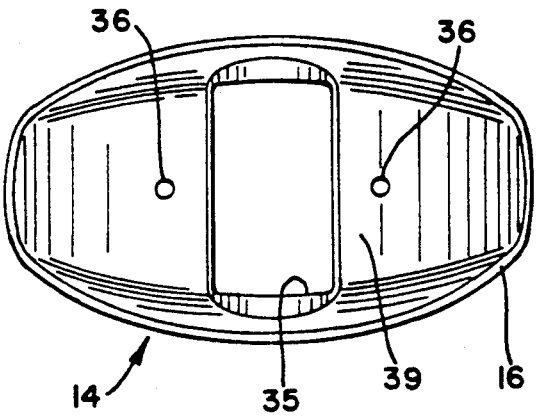
FIG. 4 is a bottom plan view of the shroud member.

Referring to FIGS. 2 and 4, shroud member 14 contains an opening 35 constructed in such a manner to permit flip-top 32 and thus opening 31 to extend through shroud member 14 and thus permit dispensing of a liquid medium (not shown) from container 11.

As can be seen more clearly in FIGS. 4–6, shroud member 14 contains two projections or pins 36 which are of a size and shape so as to pass closely through openings 37 in flanges 38 of seal unit 13. In this embodiment, pins 36 are a molded part of shroud member 14 and thus are made from the same thermoplastic material from which shroud member 14 is made. Pins 36 are constructed such that a portion of each pin 36 extends beyond openings 37 in flanges 38. As shown in FIGS. 5 and 6, the portion of pins 36 extending beyond flange 38 are either melted by the application of a heated rod (not shown) or a pointed metal punch is passed into the center of pins 36 to spread the diameter of the end of each pin 36 wider than the diameter of opening 35 and thus fix shroud member 14 permanently onto seal unit 13, pressing interior surface 39 firmly against top surface 40 of flange 38 to firmly attach seal unit 13 to shroud member 14. In the alternative, other means could be provided for screwing flanges 38 onto shroud member 14 or appropriately shaped flanges could simply be adhered to interior surface 39 of shroud member 14 with a suitable adhesive. The preferred method for joining seal unit 13 with shroud member 14 using a pointed punch is described in a U.S. Pat. Application Ser. No. 07/577,398 filed on Sept. 4, 1990 concurrently herewith in the name of Kenneth R. Emerson which is entitled "Thermoplastic Component Joinder Method" and is assigned to the same Assignee as is the present invention.

Figure 3:
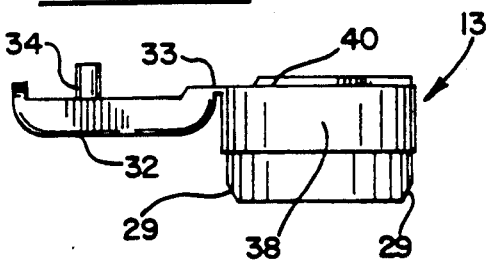
FIG. 3 is a right side view of the dispenser/container seal unit shown as it would be molded.

FIG. 3 shows dispenser/container seal unit 13 in the configuration in which it would be molded. As is shown, flip-top 32 is molded so that its top surface is parallel to the top surface 40 of seal unit 13. This eliminates any need for complicated side cores in the molds used to produce seal unit 13, but flip-top 32 must be moved into its closed position prior to placement within shroud member 14 and onto container 11. This illustrates one advantage of the present invention in that during closing of flip-top 32 after molding of seal unit 13, the same machine may be used to accomplish closing of flip-top 32 without any need to be concerned about the type of shroud member 14 used with seal unit 13.

While dispenser/container seal unit 13 is shown as having a flip-top, the dispensing means used is not critical to the present invention and could take the form of a pushpull dispenser of the type described in U.S. Pat. No. 2,998,902 to Thomas et al., a pull-off cap as shown in U.S. Pat. No. 3,227,332 to Gowdy et al., press-down dispensing units such as those described in U.S. Pat. Nos. 3,516,581 to Micallef; 3,542,256 to Waterman or 4,645,086 to Rosenthal. Other flip-top closures can be used such as are described in U.S. Pat. No. 4,457,458 to Heinol or a child resistant dispenser such as that described in U.S. Pat. No. 4,629,081.

Depending upon the configuration of container 11 and shroud 14, dispenser/container seal unit 13 could, in the alternative, contain threads to permit seal unit 13 to be screwed onto container 11 instead of the stake-on sealing means shown in the drawings. Other suitable alternative embodiments will be apparent to those of ordinary skill in the art.

Figure 7:
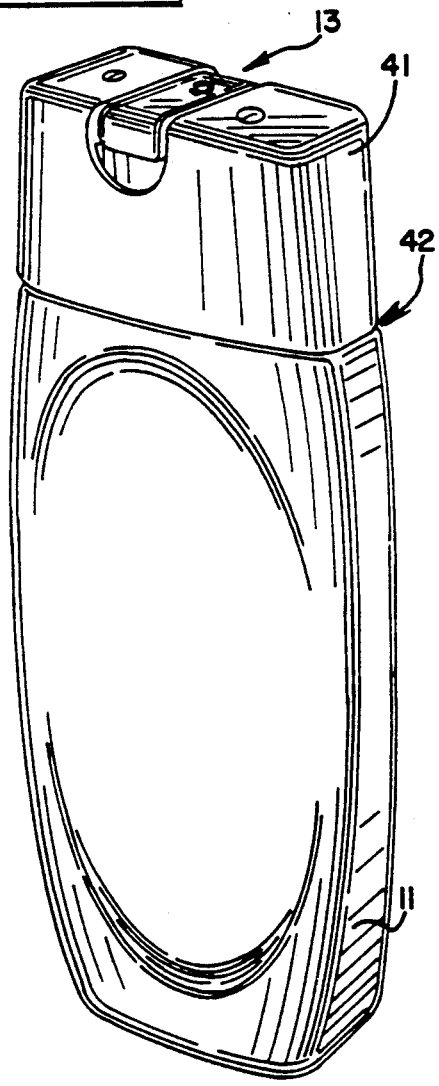
FIG. 7 is a perspective view of an alternative embodiment which employs a different shaped shroud member with the same container and dispenser/container seal unit.

FIG. 7 shows an alternative embodiment which illustrates another advantage of the present invention. In FIG. 7, container 11 and dispenser/container seal unit 13 are the same as are shown in FIG. 1, but the shape of shroud member 41 is significantly different from the shape of shroud member 14 and thus gives non-aerosol container package 42 a significantly different aesthetic appearance than non-aerosol container package 10 illustrated in FIG. 1. By retaining the same size of open end 15, the size can be modified as well as the shape of container 11 can also be modified (not shown) to present a more square or otherwise completely different appearance to a non-aerosol container simply by using dispenser/container seal unit 13 as both the container closure and dispenser and substituting a different shroud member and container.

INDUSTRIAL APPLICABILITY

Therefore, the same dispenser/container seal unit can be used with a variety of containers and shrouds to economically produce a number of different non-aerosol container packages having different appearances which can be used as containers for consumer products such as hand and body lotions, shampoos, hair conditioners, and household cleanser products.

Other modifications and variations of the present invention will become apparent to those skilled in the art from an examination of the above specification and Drawings. Therefore, other variations of the present invention may be made which fall within the scope of the appended Claims even though such variations were not specifically discussed above.

KEY TO DRAWINGS

10 Container Package
11 Open-ended Container
12 Overcap
13 Dispenser/Container Seal Unit
14 Shroud Member
15 Open end of Container 11
16 Lower Edge of Shroud Member 14
17 Shoulder of Container 11
18 Open end of Seal Unit 13
19 Guides
20 Ring
21 Outer Peripheral Wall of Open End 15
22 Inner Peripheral Wall of Open End 15
23 Circular Projection on Open End 15
24 Projections
25 Interior Sidewall
26 Interior of Seal Unit 13
27 Edge of Open End 15
28 Roof
29 Triangular Indentations
30 Triangular Projections
31 Opening in Seal Unit 13
32 Flip-top
33 Hinge
34 Plug
35 Opening in Shroud Member 14
36 Pins
37 Openings
38 Flanges
39 Interior Surface of Shroud Member 14
40 Top Surface of Flange 38
41 Alternate Shroud Member
42 Alternate Container Package

What I claim is:

1. A non-aerosol overcap for a container having an open end and filled with a fluid medium comprising (A) a dispenser/container seal unit having an open end adapted for sealing engagement with the open end of the container to retain the fluid medium within the container, a non-aerosol means for dispensing the fluid medium communicating with the open end of the seal unit and of the container, and at least one flange extending from an exterior wall of said unit for receiving (B) a shroud member which substantially overlies but does not form a functional part of the seal unit and has an opening therein through which at least a portion of the dispensing means extends to permit dispensing of the fluid medium when the seal unit is sealingly engaged with the open end of the container, the shroud member being adapted to form an integral portion of the container and which blends in with the design of the container and containing a means for permanently fixing an interior wall of the shroud member to the flange of the seal unit.

2. A non-aerosol overcap for a container having an open end and filled with a fluid medium comprising (A) a dispenser/container seal unit having an open end adapted for sealing engagement with the open end of the container to retain the fluid medium within the container, a non-aerosol means for dispensing the fluid medium communicating with the open end of the seal unit and of the container, and at least one flange extending from an exterior wall of said unit for receiving (B) a shroud member which substantially overlies but does not form a functional part of the seal unit and has an opening therein through which at least a portion of the dispensing means extends to permit dispensing of the fluid medium when the seal unit is sealingly engaged with the open end of the container, the shroud member being adapted to form an integral portion of the container and the shroud member contains at least one projection extending from an interior wall of the shroud member for mating engagement with corresponding openings in the flange to permanently fix the interior wall to the flange.

3. A non-aerosol overcap for a container having an open end and filled with a fluid medium comprising (A) a dispenser/container seal unit having an open end adapted for sealing engagement with the open end of the container to retain the fluid medium within the container, a non-aerosol flip-top dispenser for dispensing the fluid medium communicating with the open end of the seal unit and of the container, and at least one flange extending from an exterior wall of said unit for receiving (B) a shroud member which substantially overlies the seal unit and has an opening therein through which at least a portion of the flip-top dispenser extends to permit dispensing of the fluid medium when the seal unit is sealingly engaged with the open end of the container, the shroud member being adapted to form an integral portion of the container and which blends in with the design of the container and containing a means for fixing an interior wall of the shroud member to the flange of the seal unit.

4. A non-aerosol overcap for a container having an open end and filled with a fluid medium comprising (A) a dispenser/container seal unit having an open end adapted for sealing engagement with the open end of the container to retain the fluid medium within the container, a non-aerosol flip-top dispenser for dispensing the fluid medium communicating with the open end of the seal unit and of the container, and at least one flange extending from an exterior wall of said unit for receiving (B) a shroud member which substantially overlies but does not form a functional part of the seal unit and has an opening therein through which at least a portion of the flip-top dispenser extends to permit dispensing of the fluid medium when the seal unit is sealingly engaged with the open end of the container, the shroud member being adapted to form an integral portion of the container and the shroud member contains at least one projection extending from an interior wall of the shroud member for mating engagement with corresponding openings in the flange to permanently fix the interior wall to the flange.

* * * * *